United States Patent [19]

Oda

[11] Patent Number: 4,524,595

[45] Date of Patent: Jun. 25, 1985

[54] METHOD OF MANUFACTURING SHEET METAL MADE POLY-V PULLEYS

[75] Inventor: Misao Oda, Hyogo, Japan

[73] Assignee: Kabushiki Kaisha Kanemitsu, Japan

[21] Appl. No.: 533,749

[22] Filed: Sep. 19, 1983

[51] Int. Cl.[3] ..... B21D 53/26

[52] U.S. Cl. ..... 72/84; 72/105; 29/159 R

[58] Field of Search ..... 72/68, 84, 105, 106; 29/159 R

[56] References Cited

U.S. PATENT DOCUMENTS

| | | | |
|---|---|---|---|
| D. 266,982 | 11/1982 | Kanemitsu | D8/360 |
| D. 266,983 | 11/1982 | Kanemitsu | D8/360 |
| D. 266,984 | 11/1982 | Kanemitsu | D8/360 |
| D. 267,472 | 1/1983 | Kanemitsu | D8/360 |
| D. 267,540 | 1/1983 | Kanemitsu | D8/360 |
| D. 267,541 | 1/1983 | Kanemitsu | D8/360 |
| D. 268,092 | 3/1983 | Kanemitsu | D8/360 |
| 2,139,833 | 12/1938 | Le Jeune et al. | 29/159.1 |
| 2,471,906 | 5/1949 | Smith | 474/170 |
| 2,656,730 | 10/1953 | Mitchell | 29/159 R |
| 2,787,914 | 4/1957 | Nelson | 474/168 |
| 2,878,551 | 3/1959 | Woodward | 29/159.1 |
| 3,368,376 | 2/1968 | Previte | 72/82 |
| 3,457,751 | 7/1969 | Lindeman | 72/105 |
| 3,722,309 | 3/1973 | Shaffer | 474/169 |
| 3,772,928 | 11/1973 | Gobeille | 74/230.7 |
| 3,838,485 | 10/1974 | Oldford | 474/170 |
| 3,907,371 | 9/1975 | Leudi et al. | 29/159.1 |
| 3,945,102 | 3/1976 | Kotlar | 29/159 R |
| 3,953,995 | 5/1976 | Haswell et al. | 72/105 |
| 3,962,926 | 6/1976 | Kotlar | 474/168 |
| 3,977,264 | 8/1976 | Sproul | 29/159 R |
| 3,994,181 | 11/1976 | Sproul | 474/170 |
| 4,050,321 | 9/1977 | Kraft | 74/230.8 |
| 4,078,410 | 3/1978 | Lemmo | 72/82 |
| 4,080,704 | 3/1978 | Blakesley | 29/159 R |
| 4,083,215 | 4/1978 | Guetzlaff | 72/82 |
| 4,086,798 | 5/1978 | Lemmo | 72/82 |
| 4,197,756 | 4/1980 | Yaros | 74/230.3 |
| 4,273,547 | 6/1981 | Bytzek | 474/170 |
| 4,313,323 | 2/1982 | Kanemitsu | 72/84 |

OTHER PUBLICATIONS

Italian Patent 508,176, Dated 1/55, (Ghirelli).

German Offenlegungsschrift 28 22 056, Dated 11/79, (Mittermeier).

*Primary Examiner*—Lowell A. Larson

*Attorney, Agent, or Firm*—Steele, Gould & Fried

[57] ABSTRACT

An improvement in a method of manufacturing poly-V pulleys made of sheet metal, which is performed by subjecting a preformed cupshaped blank to working by a corrugating roller, an auxiliary forming roller and a finish forming roller. Prior to corrugation of the blank by the corrugating roller, a connecting portion between the peripheral wall and the bottom wall of the blank is pressed in a manner that the inside surface of the peripheral wall and the inside surface of the bottom wall are pressed into contact with each other, thereby to preform a lug which provides a side wall for grooves adjacent to the connecting portion.

7 Claims, 16 Drawing Figures

IX
IX
1
26
26a
7'
25b
25a
25
25'
9
6'
27a
27
28
6'a
25'a
25''
25''a
7'

METHOD OF MANUFACTURING SHEET METAL MADE POLY-V PULLEYS

BACKGROUND OF THE INVENTION

1. Field of the Invention

This invention relates to a method of manufacturing a sheet metal made poly-V pulley having a plurality of poly-V grooves arranged at a fixed pitch on the outer surface of a peripheral wall of the pulley.

2. Prior Art

In recent years there has been developed a poly-V belt which has replaced a V-belt and which is provided on the inner surface of a belt and along the direction of travel with a plurality of ridges engaging with a plurality of poly-V grooves (about 3.5 mm in width) of poly-V pulleys and various poly-V pulleys for use in the poly-V belt have been developed.

Since the poly-V pulley of the kind described makes it necessary for a plurality of ridges formed on the inner surface of one poly-V belt to engage with the poly-V grooves of the poly-V belt, the accuracy of each poly-V groove of the order of 5/100 mm is rigorously demanded, and consequently the pitch, width, and diameter of each poly-V groove must be finished to close tolerances.

In an attempt to meet such demand, the applicant proposed a method of manufacturing a sheet metal made poly-V pulley (Japanese Patent Application No. 113820/1979, corresponding to U.S. Pat. No. 4,313,323) wherein the peripheral wall of a cup-shaped blank is pressed from outside of the wall by a corrugating roller to bring the wall into a shape of corrugated section in a manner to form ridges alternated with grooves on the outer surface of the peripheral wall, the peripheral wall of the cupshaped blank is subjected axially to compression forming in the state of the outer peripheral edge of an axially movable auxiliary forming roller being inserted into each groove of the corrugated wall, and thereafter the grooves on the outer surface of the peripheral wall are formed into specified poly-V grooves by form rolling adapted to press a finish forming roller against the grooves. According to this method of manufacture, it was possible to greatly improve the accuracy of an article, but the V-grooves obtained or the articles thus produced were not free from variations in accuracy. The proposed method has had something yet to be desired in that it lacked stability of article accuracy.

SUMMARY OF THE INVENTION

Accordingly, it is a primary object of the invention to provide a method of manufacturing a sheet metal made poly-V pulley which method makes it possible to reduce variations in accuracy between the V-grooves and between the articles produced to thereby improve article accuracy.

This invention comprises generally steps of forming a cupshaped blank, preforming, corrugating, compressing, and finishing the blank.

In the step of forming the cupshaped blank, a sheet metal blank is formed as by pressing into a cupshaped cylindrical blank with a bottom. In the step of preforming the blank, a connecting portion between the peripheral and bottom wall portions of the cupshaped blank is pressed in the state in which the inner surface of the peripheral wall and that of the bottom wall are pressed into contact with each other to preform a bottom edge which provides a side wall for the grooves adjacent to the connecting portion.

In the step of corrugating the cupshaped blank, the peripheral wall of the blank is corrugated the preformed bottom end edge being pressed between an upper rotary support die and a finish forming roller so as to provide the outer surface of the peripheral wall with a shape corrugated in section having ridges alternated with grooves formed therein.

In the step of compressing the blank, the outer peripheral edges of an auxiliary forming roller capable of axially moving are inserted into the grooves of the corrugate peripheral wall and the peripheral wall of the cupshaped blank is subjected axially to compression forming in the state in which the preformed bottom end edge is pressed between an upper rotary pressure die and the auxiliary forming roller.

In the final step of finishing the blank, the preformed bottom edge and compression formed peripheral wall are subjected to finish forming into a sheet metal made poly-V pulley by form rolling of a finish forming roller.

BRIEF DESCRIPTION OF THE DRAWINGS

FIGS. 1 to 11 show one embodiment of the invention wherein:

FIG. 1 is a longitudinal sectional elevation showing a cupshaped blank in its entire configuration;

FIG. 2 is a segmentary longitudinal sectional elevation showing the cupshaped blank subsequent to formation of both end edges of a peripheral wall;

FIG. 3 is a segmentary longitudinal sectional elevation showing the peripheral wall of the cupshaped blank subsequent to corrugation;

FIG. 4 is a segmentary longitudinal sectional elevation showing the peripheral wall of the cupshaped blank subsequent to compression forming;

FIG. 5 is a segmentary longitudinal sectional elevation showing the peripheral wall of a sheet material made poly-V pulley subsequent to form rolling;

FIG. 6 is a front elevation, partly in section, showing the state of both end edges of the peripheral wall being formed in the preforming step;

FIG. 7 is an enlarged front elevation in section showing the essential part of FIG. 6;

FIG. 8 is a front elevation, partly in section, showing the state of corrugation of the peripheral wall;

FIG. 10 is a front elevation, partly in section, showing the state of finish forming by form rolling of the peripheral wall;

FIG. 11 is a front elevation in section showing the essential part of FIG. 10 on an enlarged scale;

DETAILED DESCRIPTION OF THE PREFERRED EMBODIMENT

A detailed description will now be given of one preferred embodiment of the invention with reference to FIGS. 1 to 11. The embodiment is the case of application of the invention to a method of manufacturing a sheet metal made poly-V pulley having lugs at both end edges of the peripheral wall portion.

Figure 1:
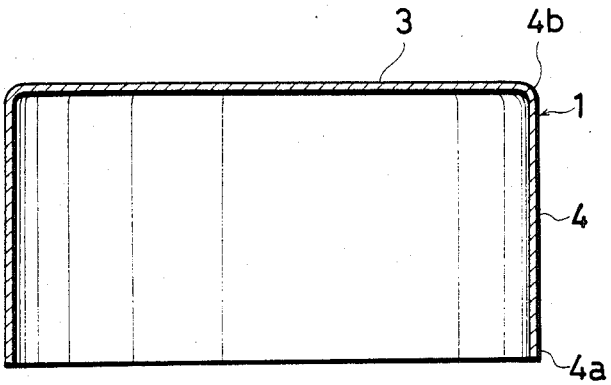

First, a circular material blanked out from sheet metal is subjected to drawing to form a cup-shaped cylindrical bottomed blank 1 as shown in FIG. 1.

Figure 2:
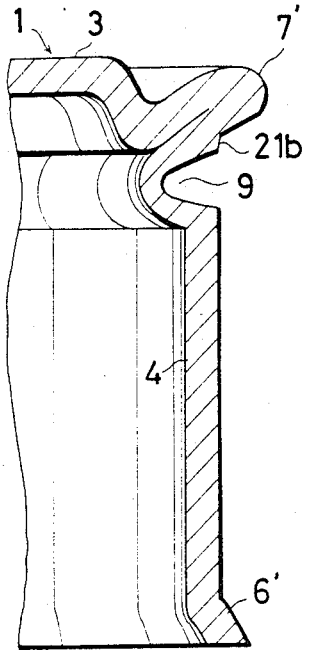

Prior to corrugation of the peripheral wall 4 of the cup-shaped blank 1, a connecting portion 4*b* between the peripheral wall 4 and a bottom 3, as shown in FIG. 2, is pressed in a manner to bring the inner surface of the wall 4 and the inner surface of the bottom 3 into contact with each other to thereby preform a bottom end edge 7′ which provides a side wall for grooves 9 adjacent to the connecting portion 4. In this case, to use the base end edge 7′ as a lug 7 to be later described, the edge 7′ is preformed in the state of its projecting radially outwardly from the peripheral wall 4 and a stepped portion 21*b* is preformed on the side wall of the bottom end edge 7′ as shown in FIG. 2.

On the other hand, an opening end edge 6′ projecting radially outwardly from the perpheral wall 4 is formed by expanding the opening side end edge 4*a* of the wall 4.

Figure 7:
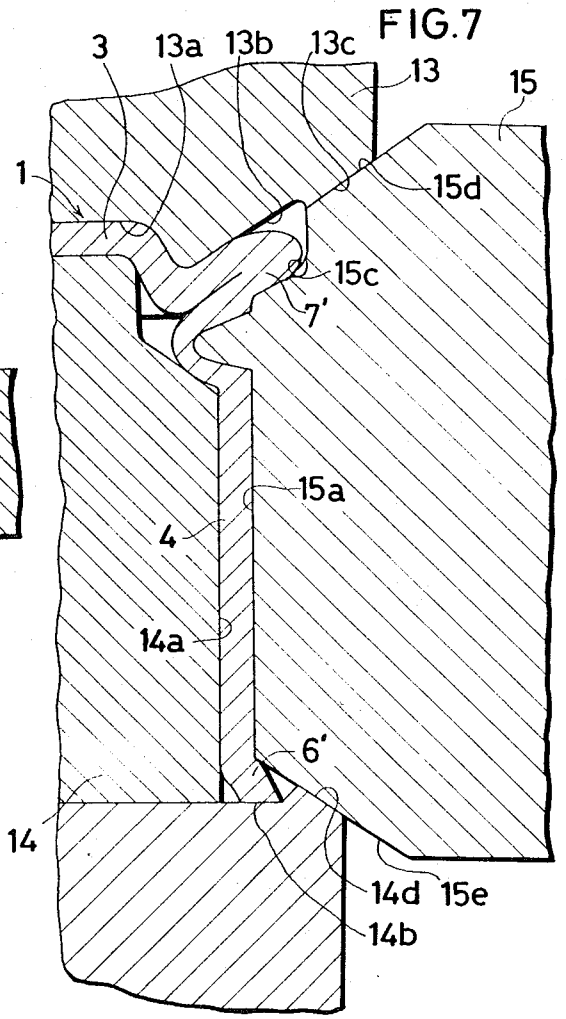
Figure 6:
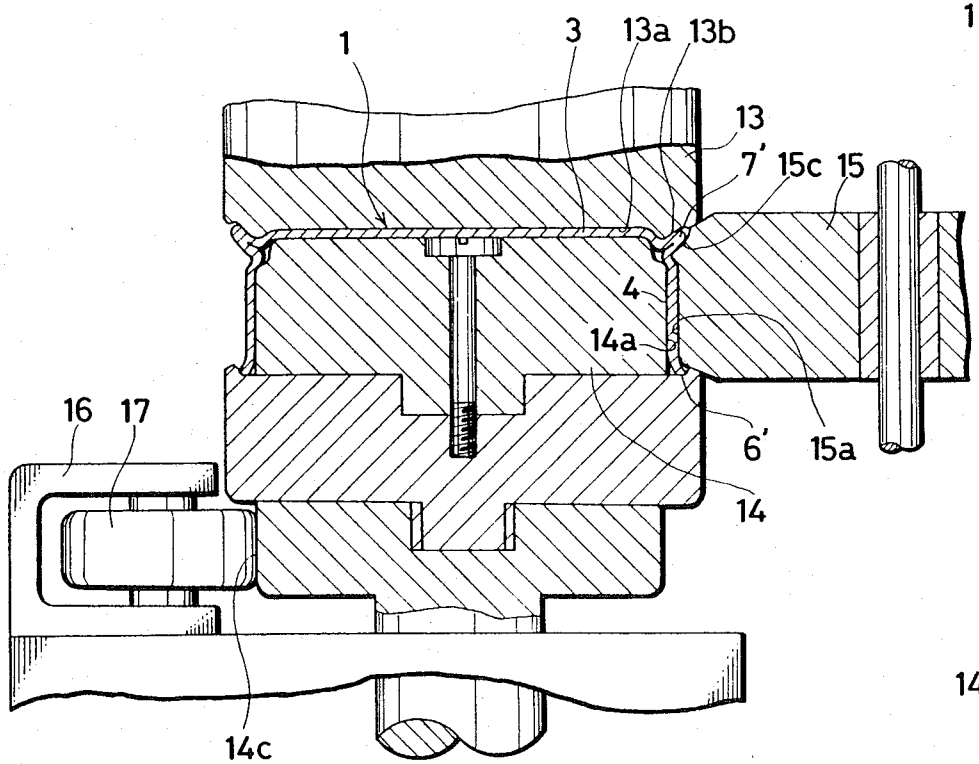

Referring to a method of forming the opening end edges 6′ and the bottom end edge 7′, the cupshaped blank as shown in FIGS. 6 and 7 is supported between a pair of upper and lower rotary preforming dies 13 and 14, and while the dies are being rotated, the inner and outer peripheries of the wall 4 of the cupshaped blank 1 are supported between the roll surface 14*a* of the lower rotary preforming die 14 and the roll surface 15*a* of the side wall preforming roll 15 and, at the same time, the upper rotary preforming die 13 is lowered to axially press the peripheral wall 4 to thereby use the downward pressure of the die 13 to form the radially outwardly projecting opening end edge 6′ by expanding at the opening side end edge 4*a*. Thereafter, the upper die 13 continues with its downward movement and a connecting portion 4*b* of the wall 4 is pressed between a bottom end preforming portion 13*b* of the upper die 13 and the bottom end preforming portion 15*c* of the side wall preforming roller 15 in the state in which the peripheral wall 4 of the cupshaped blank 1 is axially supported between the abutment end 14*b* of the lower die 14 and the lower surface 13*a* of the upper die 13 so as to form the radially outwardly projecting bottom end portion 7′ as shown in FIG. 7. Furthermore, in the state of the upper die 13 having been lowered to its lowest limit position, as shown in FIG. 7, the abutment surface 13*c* of the upper die 13 abuts against the upper tapered surface 15*d* of the side wall preforming roller 15 and the abutment surface 14*d* of the lower rotary preforming die 14 abuts against the lower tapered surface 15*e* of the roller 15, while the space between the upper rotary die 13 lowered to its lowest limit position and the lower rotary die 14 is kept constant through the side wall preforming roller 15, so that the inner surface of the peripheral wall 4 and the inner surface of the bottom wall 3 are pressed into contact with each other in a specified state. Furtheremore, a rotatable pressure roller 17 journalled in a fixed frame 16 is provided opposite the side wall preforming roller 15, and the lower die 14 is prevented from deflecting toward the opposite side of the side roller 15 by pressing the pressure roller 17 against the side surface 14*c* of the lower die 14.

Figure 3:
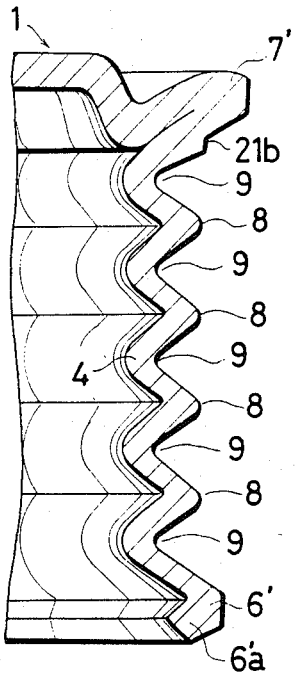
Figure 8:
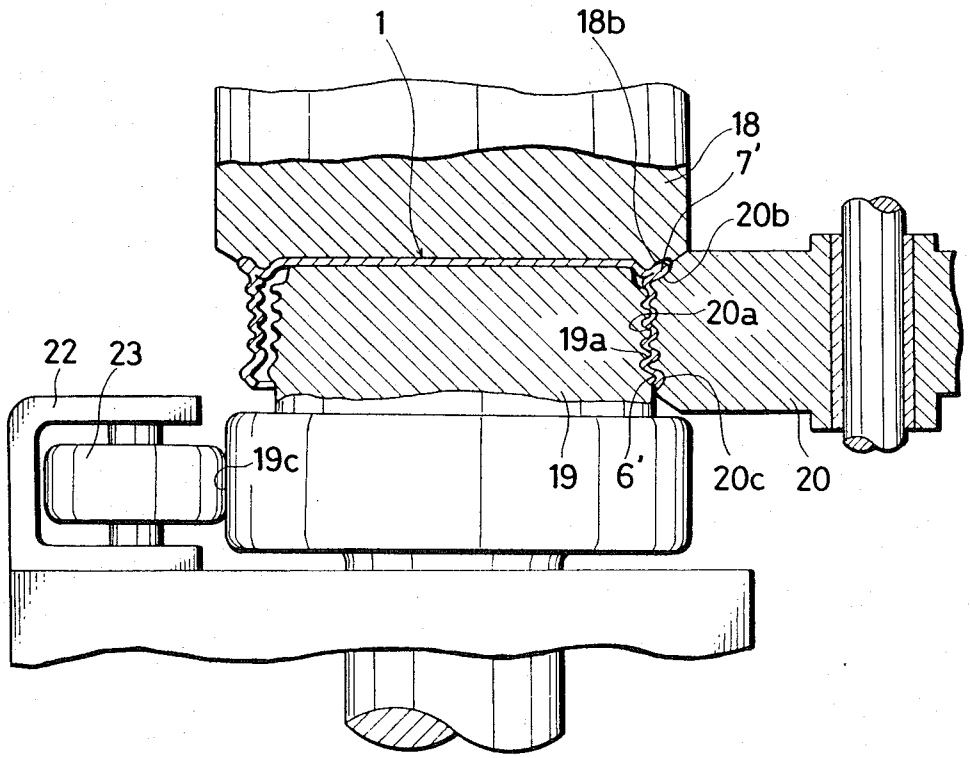

As described above, the corrugation of the peripheral wall 4 by which the bottom end edge 7′ is formed at the connecting portion 4*b* of the cupshaped blank 1 is effected by pressing the inner and outer peripheries of the peripheral wall 4 of the blank 1 by use of a pair of inner and outer corrugating roll surfaces 19*a* and 20*a* while the blank 1 is being rotated by being supported by and between a pair of upper and lower rotary support dies 18 and 19. Namely, the inner corrugating roll surface 19*a* formed on the outer periphery of the lower rotary support die 19 is formed to be smaller in outer diameter than the inner diameter of the peripheral wall 4 and is caused to rotate in the eccentric position on the corrugating roller 20 with respect to the blank 1 so as to bring the roll surface 19*a* into contact with the inner periphery of the wall 4. The cupshaped blank 1 is formed to have its peripheral wall 4 corrugated in section having ridges 8 alternated with grooves 9 formed thereon, as shown in FIGS. 3 and 8 by pressing the wall 4 from outside by the corrugating roller 20 having an outer corrugating roll surface 20*a* and by the pressing force of the roll surfaces 19*a* and 20*a*. In this corrugating operation corrugation rolling of the peripheral wall 4 as shown in FIG. 8 is effected in the state in which the bottom end edge 7′ is sandwiched between a bottom end supporting portion 18*b* of the upper rotary support die 18 and a bottom end supporting portion 20*b* of the corrugating roller 20. By so doing, the upper end portion of the peripheral wall 4 is positively fixed, so that upwardly excessive deformation of the wall 4 is controlled. Furthermore, the opening end edge 6′ of the peripheral wall 4 is bent inwardly by pressing of a folding portion 20*c* of the corrugating roller 20 and the lower end portion of the peripheral wall is supported by the U-shaped structure of the folding portion 20*c*.

A structure opposite the eccentric direction of the lower rotary support die 19, namely a side 19*c* opposite the corrugating roller 20 is supported by a rotatable pressure roller 23 journalled in a fixed frame 22 to prevent the lower rotary support die 19 from deflecting in the direction of pressure applied by the roller 20.

Figures 9A, 9B:
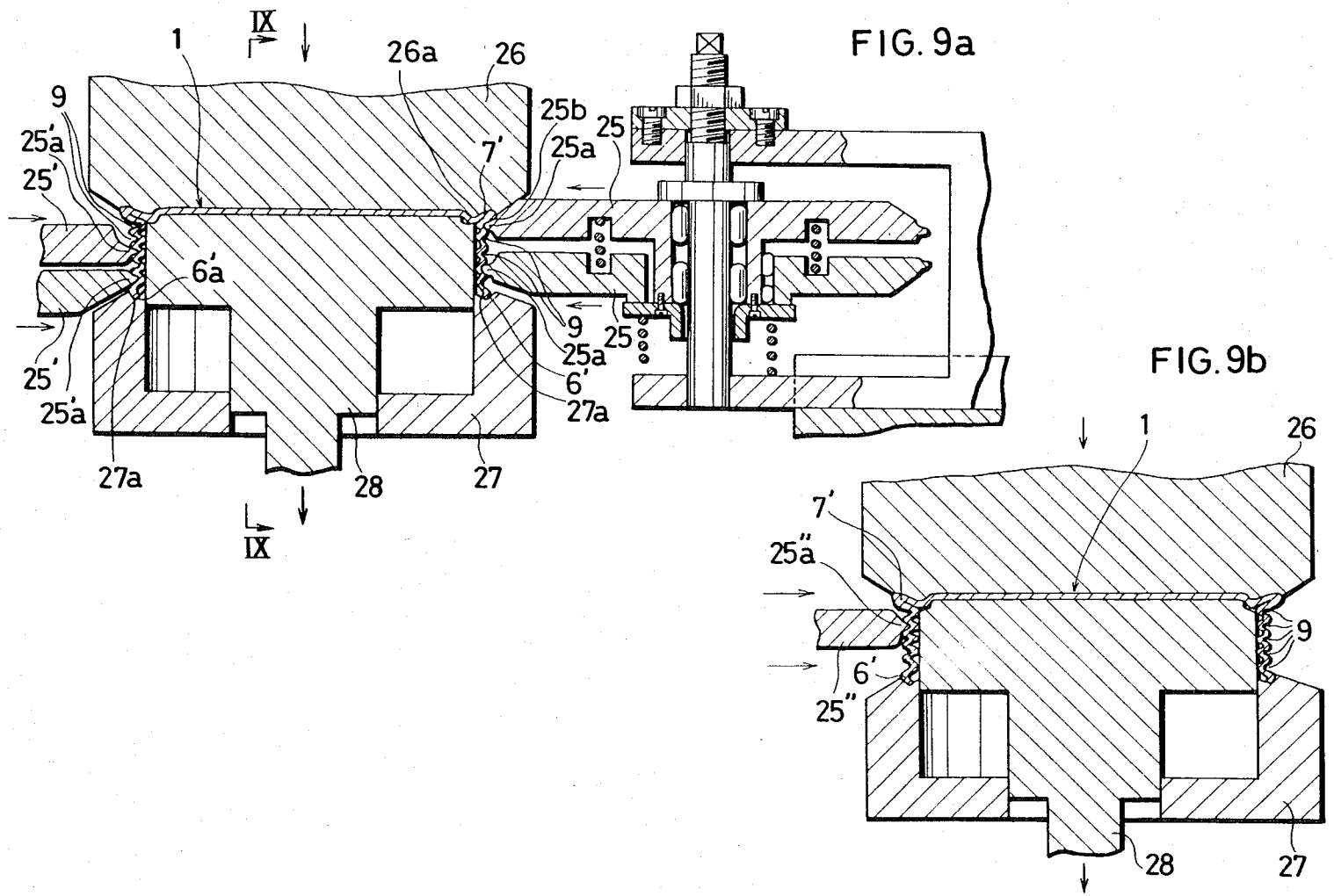
FIG. 9*a* is a front elevation in section showing the state of compression forming of the peripheral wall.
FIG. 9*b* is a front elevation in section taken along the line IX—IX of FIG. 9.

Next, compression forming with respect to the peripheral wall 4 corrugated in section, as shown in FIGS. 9A and 9B, is effected in the state in which the peripheral edges 25*a*, 24′*a*, 25″*a* of axially movable auxiliary forming rollers 25, 25′, 25″ are inserted into the grooves 9. Namely, a pair of upper and lower rotary pressure dies 26 and 27 for compressing the peripheral wall 4 corrugated in section from an axial direction, a female die 28 on the inner periphery side of the peripheral wall 4, and three auxiliary forming rollers 25, 25′ 25″ disposed peripherally of the cupshaped blank 1 are prepared. First, the female die 28 is held in its elevated state and the corrugated cupshaped blank 1 is sandwiched between the upper and lower rotary pressure dies 26 and 27. Furthermore, the bottom end edge 7′ of the blank 1 is sandwiched between the bottom end supporting portion 26*a* of the upper roller 26 and the bottom end supporting portion 25*b* of the auxiliary forming roller 25 in its uppermost position, while on the other hand, the end edge 6′ of the wall 4 of the blank 1 is brought into abutment against the abutment end 27*a* of the lower rotary pressing die 27. Furthermore, the peripheral edges 25*a*, 25′*a* and 25″*a* if the auxiliary forming rollers 25, 25′ and 25″ are inserted into the grooves 9 of the peripheral wall 4.

Figure 4:
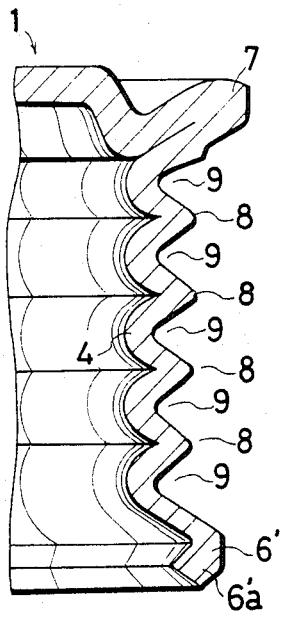

While the upper and lower rotary pressure dies 26 and 27 are being axially rotated, the upper rotary pressure die 26 is lowered and, along therewith, the female die 28 is also lowered to finally fold the peripheral wall 4 in a zigzag manner as shown in FIG. 4. By so doing, the grooves 9 of the wall 4 are compressed in the state in which the grooves 9 are supported by the peripheral edges 25*a*, 25'*a* and 25''*a* of the auxiliary forming rollers 25, 25' and 25'', and since the compression is effected in the state in which the bottom end edge 7' is sandwiched between the bottom end supporting portion 25*b* in its uppermost position and the bottom end supporting portion 26*a* of the upper rotary pressure die 26, the peripheral wall 4 is compressed in the axial direction of the wall 4 without excessive deformation.

Figure 5:
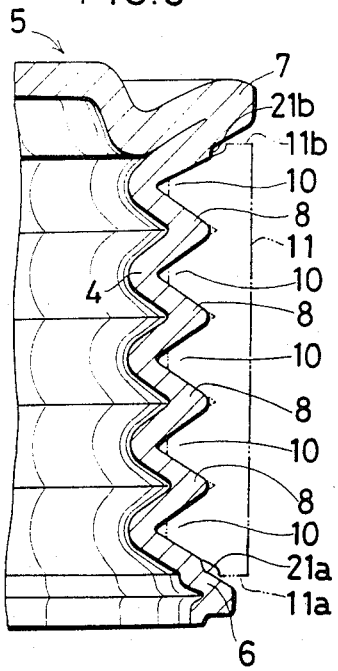
Figure 10:
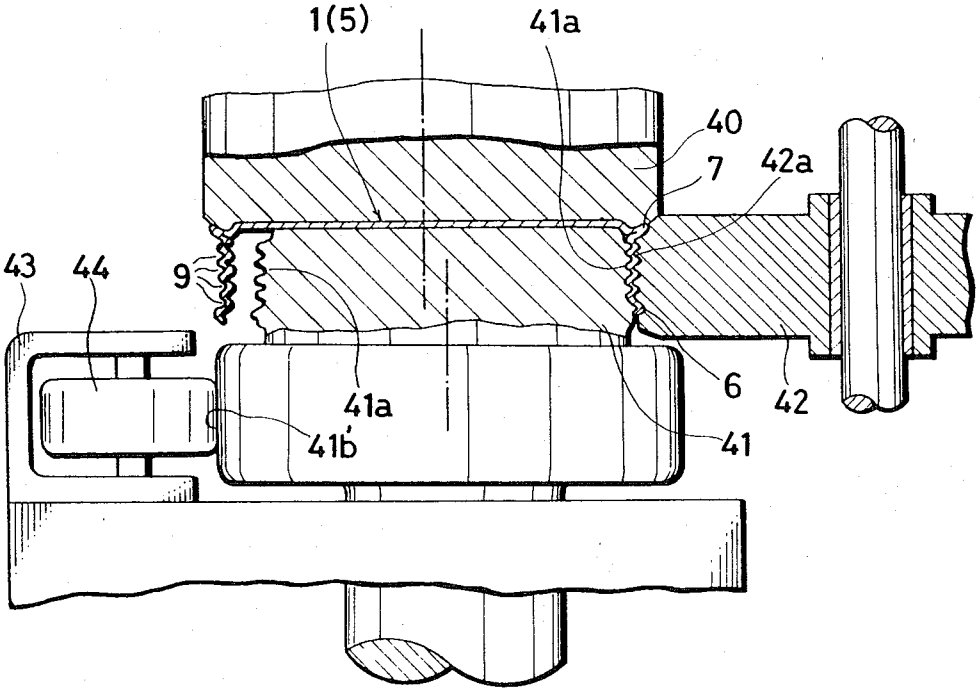
Figure 11:
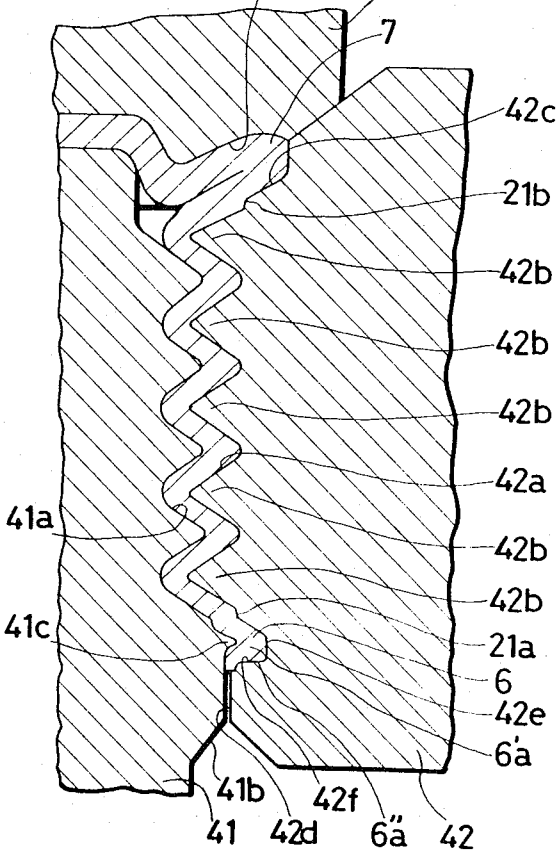

In the final step of form rolling, as shown in FIGS. 10 and 11, while the cupshaped blank 1 is axially being rotated by being supported on a pair of upper and lower rotary support discs 40 and 41, the blank 1 is finished to form the V-grooves 10 shown in FIG. 5 by the peripheral wall 4 folded in a zigzag manner in the preceeding step being supported from the outer periphry side on a V-groove finishing roll surface 42*a* and furtheremore from the inner periphery side on female roll surface 41*a*. Namely, the female roll surface 14*a* on the outer periphery of the lower rotary support die 41 is formed to be smaller in outer diameter than the inner diameter of the peripheral wall 4 and is caused to rotate in the eccentric position on the finish forming roller 42 side with respect to the blank 1 to bring the roll surface 41*a* into contact with the inner periphery of the wall 4. Specified V-grooves 10 are formed by form rolling adapted to press the finish forming roller 42 against the wall 4 in the state in which ridges 42*b* formed on the outer periphery of the V-groove finishing roll surface 42*a* are brought into agreement with the grooves 9. As shown in FIGS. 10 and 11, forming of V-grooves in this case is effected in the state in which the bottom end edge 7' of the peripheral wall 4 is sandwiched between the bottom end supporting portion 40*a* of the upper rotary support die 40 and the bottom end supporting portion 42*c* of the finish forming roller 42. By so doing, upwardly excessive deformation of the peripheral wall 4 is controlled. The bottom end edge 7' is finished up to a specified lug 7 having a stepped portion 31*b* formed on the inside surface thereof by pressure of the bottom end supporting portion 42*c* of the finish forming roller 42, while on the other hand, an opening end edge 6', as shown in FIG. 11, is sandwiched between the protuberant portion 41*c* on the outer periphery 41*b* of the lower rotary support die 41 and the peripheral groove 42*e* on the outer periphery 42*d* of the finish forming roller 42, and the finish forming roller 42 is pressed in the state in which the end face 6''*a* if the end edge 6'*a* of the opening end edge 6' is brought into abutment against the not-so stepped face 42*f* continued from the peripheral groove 42*e* of the roller 42 and formed toward the outer periphery 41*b* of the lower rotary support die 41, and thus the specified lug 6 having a stepped portion 21*a* on the inside surface thereof is formed.

The stepped portions 21*a* and 21*b*, as shown in FIG. 5, is intended to make the sides 11*a*, 11*b* of the V-belt 11 free of contact with the lugs 6, 7 of the poly-V pulley 5, thereby preventing reduction in transmission efficiency of rotation caused by contact of the poly-V belt 11 with the lugs 6, 7 of the poly-V pulley 5 and also preventing damage of the poly-V belt 11.

A rotatable pressure roller 44 journalled in a fixed frame 43 bears against the side 41*b*' of the lower rotary support die 41 opposite the finish forming roller 42, thereby preventing the lower rotary support die 41 from deflecting in the direction of pressure applied by the finish forming roller 42.

It is to be understood that the invention is not limited to the embodiment shown having the stepped portions 21*a* and 21*b* formed at the lugs 6 and 7. For example, it is possible to provide the poly-V pulley 5' having inclined surfaces 21*a*' and 21*b*' formed thereon for moving away from each other as shown in FIG. 12, or a poly-V pulley 5'' having no lug formed thereon as shown in FIG. 13.

Figure 13:
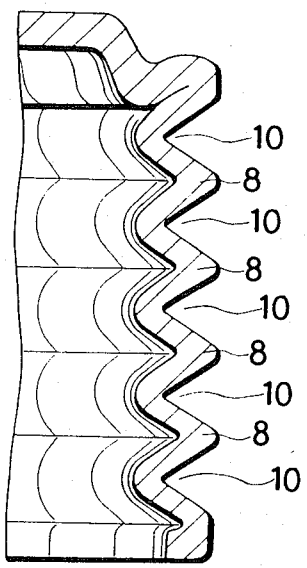
FIGS. 12 and 13 are segmentary sectional elevations showing different embodiments, respectively corresponding to FIG. 5.
Figure 12:
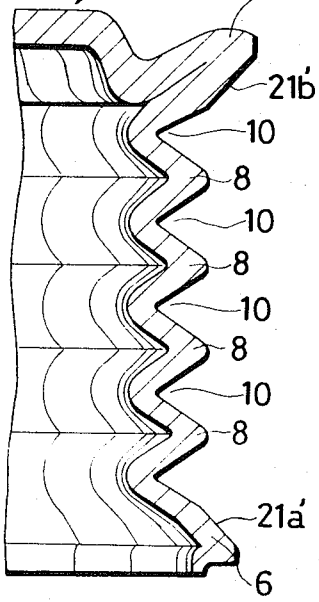

Since FIGS. 12 and 13 are the same in other details as FIGS. 1 to 11, the members and parts therein are designated by the same reference characters with no further description given.

Figure 15:
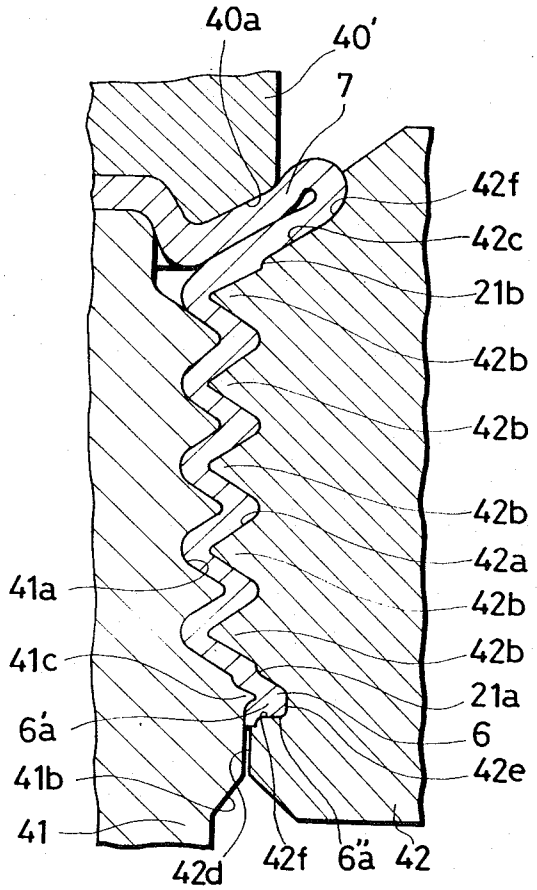
FIG. 15 is a still another embodiment of the invention.
Figure 14:
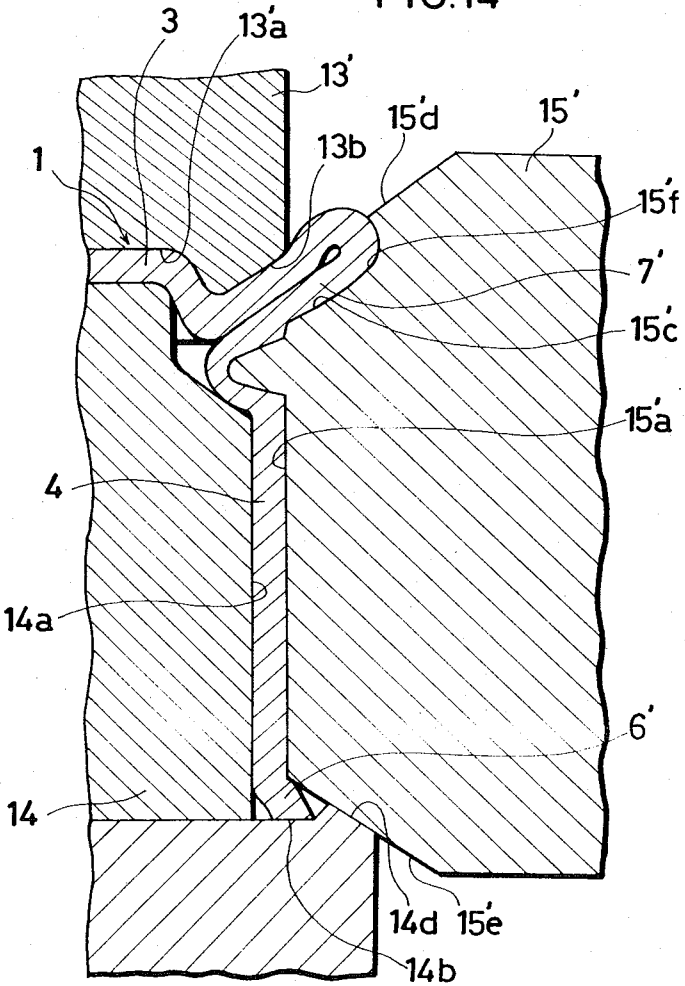
FIG. 14 is a segmentary front elevation in section of another embodiment of the invention corresponding to FIG. 7.

FIGS. 14 and 15 show another embodiment of the method according to the invention.

In the embodiment, a lug 7 is formed, prior to corrugation, by use of an upper rotary preforming die 13' and a side wall preforming roller 15', wherein the die 13' is reduced in diameter to such a degree that the peripheral edge of the bottom wall 3 is exposed and the roller 15' has a recess 15'*f* formed therein for receiving the bottom end edge 7' thereinto from below. Accordingly, the lug 7 of the cupshaped blank 1 is formed with a circular cavity 7*a* as shown. The cavity 7*a* formed in this manner makes it possible to disperse concentrated load on the pulley, resulting advantageously in an increase in the strength of the pulley itself.

FIGS. 14 and 15, since the prime reference charactors represent portions corresponding to those represented by the non-prime reference characters in FIGS. 7 and 11, a further description is omitted.

As described above, this invention is characterized in that, prior to corrugation, a connecting portion between the peripheral wall and the bottom wall of the cupshaped blank is pressed in such a manner that the inside surface of the peripheral wall and the inside surface of the bottom wall are pressure welded to each other to thereby preform a bottom end edge providing a side wall for grooves adjacent to the connecting portion. Accordingly, preformation of a sheet metal into a cupshaped blank prior to the corrugation of the bottom end edge makes it possible for the bottom end edge of the blank to function as a reference point for measuring dimensional accuracy of each V-groove when the V-groove is formed in its each subsequent step (a corrugating step, compression forming step, finish forming step) and thus reduce variations in accuracy both between the V-grooves and between the products and improve article accuracy.

Further, the invention can dispense with that protuberant portion of the conventional internal die which supports the inside surface of the peripheral wall and the inside surface of the bottom wall in the connecting portion of the cupshaped blank in the steps subsequent to the preforming of the bottom end edge. Accordingly, the invention removes the disadvantage that break of the protuberant portion mentioned above reduces article accuracy.

What is claimed is:

1. A method of manufacturing sheet metal poly-v pulleys, comprising the steps of:

forming a cup-shaped blank having a peripheral wall and an end wall joined at a connecting portion;

pre-forming a lug between the end wall and the peripheral wall by pressing the end wall and peripheral wall toward one another around the connecting portion between the end wall and the peripheral wall such that inside surfaces of the end wall and the peripheral wall are pressed into contact, said lug forming at least a part of an uppermost V-groove;

after said preforming step, pressing a corrugating roller against the peripheral wall from outside the blank to bring the wall into a corrugated shape having ridges alternating with grooves on an outer surface of said peripheral wall, the corrugating roller also pressing against said uppermost V-groove;

axially compressing the peripheral wall while keeping the corrugating roller inserted in the respective grooves, thereby forming poly-v grooves of predetermined spacing; and, finishing the grooves by pressing a finish forming roller in the grooves.

2. The method of claim 1, wherein said preforming step is accomplished by pressing the end wall with a rotary preforming die having a protruding portion of a diameter less than the cup-shaped blank, the connecting portion between the end wall and the peripheral wall being deformed around the protruding portion during said preforming.

3. The method of claim 2, wheren the protruding portion of the rotary preforming die is an annular protrusion of diameter less than the diameter of the cup-shaped blank, and wherein during the preforming step, the blank is pressed radially inward from outside the peripheral wall by a preforming roller having a corrugating portion adjacent said connecting portion for forming the lug, the corrugating portion on the performing roller also forming the uppermost V-groove.

4. The method of claim 3, wherein said corrugating section on the preforming roller is spaced from an upper periphery of the preforming roller, thereby forming a shoulder between the lug and the uppermost V-groove during said preforming step.

5. The method of claim 2, wherein said preforming step further comprises axially compressing the cup-shaped blank by axially pressing the peripheral wall against a formed abutment at an edge of the peripheral wall opposite said end wall, the preforming roller pressing radially inward against the peripheral wall to flare the edge of the peripheral wall opposite the connecting portion.

6. The method of claim 5, wherein the finishing step comprises forming a shoulder to space the flared edge of the peripheral wall from a lowermost V-groove.

7. The method of claim 1, wherein during the preforming step the peripheral wall and end wall are pressed into contact at a space from the connecting portion to thereby form the lug with a circular cavity therein.

* * * * *